US006099398A

United States Patent [19]

Jacobson et al.

[11] Patent Number: 6,099,398

[45] Date of Patent: Aug. 8, 2000

[54] MEDIA ASSIST GASEOUS NITROGEN DISTRIBUTION SYSTEM FOR DEFLASHING MACHINE

[75] Inventors: Ronald F. Jacobson; Ruben D. Mendez, both of Santa Ana, Calif.

[73] Assignee: C.D.S. Inc., Santa Ana, Calif.

[21] Appl. No.: 09/137,477

[22] Filed: Aug. 20, 1998

[51] Int. Cl.[7] ..... B24C 9/00

[52] U.S. Cl. ..... 451/446; 451/88; 451/99; 451/86

[58] Field of Search ..... 451/88, 87, 99, 451/446; 222/630, 318

[56] References Cited

U.S. PATENT DOCUMENTS

| | | | |
|---|---|---|---|
| 3,333,367 | 8/1967 | Salvaire | 51/164 |
| 3,767,096 | 10/1973 | Coscia | 225/97 |
| 3,909,988 | 10/1975 | Kerwin et al. | 51/163 |
| 4,030,247 | 6/1977 | Grund et al. | 51/419 |
| 4,037,368 | 7/1977 | Kerwin et al. | 51/314 |
| 4,089,138 | 5/1978 | Thomson | 51/422 |
| 4,295,431 | 10/1981 | Stavlo | 108/55.1 |
| 4,312,156 | 1/1982 | McWhorter | 51/418 |
| 4,355,488 | 10/1982 | Schmitz et al. | 51/319 |
| 4,481,972 | 11/1984 | Stavlo | 137/376 |
| 4,519,812 | 5/1985 | Brull et al. | 51/422 |
| 4,521,676 | 6/1985 | Poulsen | 235/375 |
| 4,542,774 | 9/1985 | Stavlo | 141/1 |
| 4,553,999 | 11/1985 | Ziegler | 65/84 |
| 4,556,091 | 12/1985 | Poulsen | 141/82 |
| 4,564,109 | 1/1986 | Stavlo | 206/597 |
| 4,569,204 | 2/1986 | Ott | 62/63 |
| 4,582,100 | 4/1986 | Poulsen | 141/4 |
| 4,598,501 | 7/1986 | Vasek | 51/425 |
| 4,646,484 | 3/1987 | Brull | 51/436 |
| 4,648,214 | 3/1987 | Brull | 51/410 |
| 4,652,292 | 3/1987 | Ziegler et al. | 65/84 |
| 4,657,055 | 4/1987 | Poulsen | 141/83 |
| 4,704,241 | 11/1987 | Boggs | 264/161 |
| 4,708,730 | 11/1987 | Ziegler et al. | 65/261 |
| 4,793,103 | 12/1988 | Baumgart | 51/418 |
| 4,840,656 | 6/1989 | Ziegler et al. | 65/85 |
| 4,862,696 | 9/1989 | Runkvist et al. | 62/50.6 |
| 4,892,018 | 1/1990 | Boggs | 83/15 |
| 4,911,744 | 3/1990 | Petersson et al. | 65/136 |
| 4,959,101 | 9/1990 | MacNeal et al. | 75/685 |
| 4,979,338 | 12/1990 | Schmitz et al. | 51/423 |
| 5,018,312 | 5/1991 | Steckis | 51/164.1 |
| 5,129,333 | 7/1992 | Frederick et al. | 110/235 |
| 5,309,683 | 5/1994 | Hockett . | |
| 5,555,655 | 9/1996 | Yager et al. | 40/306 |
| 5,676,588 | 10/1997 | Frederick et al. | 451/86 |
| 5,695,385 | 12/1997 | Bachand et al. . | |
| 5,772,900 | 6/1998 | Yorita et al. . | |
| 5,782,677 | 7/1998 | Kanouse . | |

*Primary Examiner*—Timothy V. Eley
*Assistant Examiner*—Willie Berry, Jr.
*Attorney, Agent, or Firm*—Cislo & Thomas LLP

[57] ABSTRACT

A media assist and gaseous fluid flow distribution system for a cryogenic deflashing machine. Dry-nitrogen or other dry gas is supplied to the media assist distribution system of the present invention in order to supply a cryogenic deflashing machine with gas fluid flow. The gaseous nitrogen is distributed into the interior of the cryogenic deflashing chamber as well as serving to propel deflashing media shot into a throw wheel impeller. The throw wheel impeller then propels the media into the cryogenic deflashing chamber to deflash plastic, metal, or other appropriate work pieces. The gas distribution portion of the present invention also supplies a blast of dry nitrogen against the door to ensure that debris collecting nearby is directed towards the drain of the cryogenic deflashing chamber and the media/flash separator. Via the gaseous distribution system of the present invention, the amount of media required for impact deflashing is greatly reduced.

19 Claims, 9 Drawing Sheets

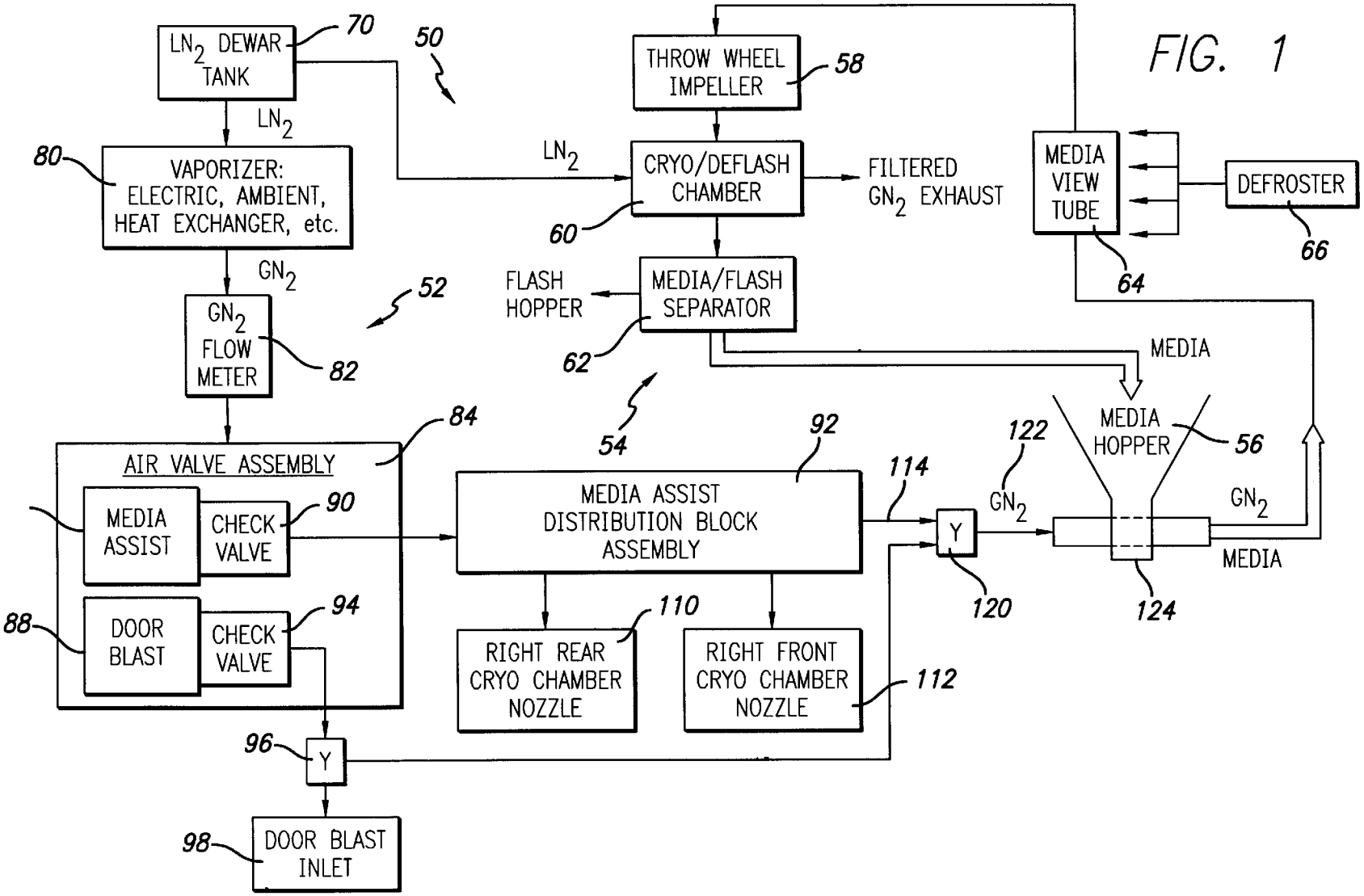
FIG. 1
DEFROSTER
66
MEDIA VIEW TUBE
64
MEDIA
MEDIA HOPPER
56
GN2
MEDIA
124
122
GN2
120
Y
114
112
FILTERED GN2 EXHAUST
THROW WHEEL IMPELLER
58
CRYO/DEFLASH CHAMBER
60
MEDIA/FLASH SEPARATOR
62
FLASH HOPPER
92
MEDIA ASSIST DISTRIBUTION BLOCK ASSEMBLY
54
RIGHT FRONT CRYO CHAMBER NOZZLE
110
RIGHT REAR CRYO CHAMBER NOZZLE
LN2
50
52
84
70
LN2 DEWAR TANK
LN2
VAPORIZER: ELECTRIC, AMBIENT, HEAT EXCHANGER, etc.
80
GN2
82
GN2 FLOW METER
AIR VALVE ASSEMBLY
90
CHECK VALVE
MEDIA ASSIST
94
CHECK VALVE
DOOR BLAST
88
Y
96
DOOR BLAST INLET
98

DOOR BLAST INLET
98
AIR VALVE ASSY DOOR BLAST
88
352
352
362
358
360
360
358/114
96
364
366
120
368
356
356
354
354
358
350
FROM MEDIA ASSIST DISTRUBUTION BLOCK (312420)
TO HOPPER ASSEMBLY

MEDIA ASSIST GASEOUS NITROGEN DISTRIBUTION SYSTEM FOR DEFLASHING MACHINE

BACKGROUND OF THE INVENTION

1. Field of the Invention

This invention relates to gas flow in cryogenic deflashing machines, and more particularly to a media-assisting pressurized gas flow system preferably using dry gaseous nitrogen to propel shot blast media throughout the cryogenic deflashing process and chamber.

2. Description of the Related Art

Cryogenic deflashing is the process by which plastic or metal parts are cooled to low temperatures using cryogenic gases in order to remove flashing, burrs, and other thin structural imperfections with controlled impact collisions. Flashing is the term used for material used in a molding process that is extraneous to the part involved. As an example, when rubber, plastic, or metal components are cast in bulk, several pieces will be cast at the same time through the same mold in a detachably connected manner. This connected manner is temporary so that the individual parts are usually removed from a central holding stem. As molds often have two halves to them, extraneous material often extrudes into the seam between the two molds to create flashing.

This flashing is easily made brittle when subjected to cryogenic temperatures. Consequently, when flashing is so embrittled, it easily shatters and fragments to leave behind the part or component of interest. Although the part or component is also subject to cryogenic temperatures, the accompanying structure is generally sufficiently stronger and able to withstand the cryogenic and controlled impact collision process.

Taking advantage of this feature of flash, burrs, and other thin structures, cryogenic deflashing machines often use liquid and gaseous nitrogen in conjunction with a rotating foramenous chamber in order to break off the flashing and separate it from the desired part or component. As some parts have flashing in interior spaces, the mere tumbling of the parts against one another only removes the exterior flashing. Consequently, additional impacts or stress must be imposed upon such interior flash. It is known in the art to use impeller throw wheels in conjunction with polycarbonate plastic blasting shot in order to provide the necessary additional impacts to clear flashing, burrs, etc. from interior portions of the parts.

Such impeller driven systems often operate on the order of thousands of rpms and may require the associated cryogenic deflashing machine to use tens to hundreds of pounds of blasting shot media.

Consequently, it would be an advantageous development in the art to provide a system by which the flow of the media through the system could be assisted in a useful manner, preferably reducing the amount of shot necessary. Additionally, such a media assist system preferably maintains the interior confines of the cryogenic deflashing machine in a dry condition as water ice is easily formed (as the temperatures drop well below the freezing point of water) and formation of ice tends to block the free flow of media through the system.

Two examples of cryogenic deflashing machines arise in U.S. Pat. No. 4,979,338 issued to Schmitz, II et al. on Dec. 25, 1990 and U.S. Pat. No. 5,676,588 issued to Frederick et al. on Oct. 14, 1997. Both of these patents describe media assist systems of different sorts. The Schmitz, II et al. '338 patent uses the exhaust from a pneumatic motor to pull the media into the impeller housing chamber by venturi effect. Shop air is used to drive a pneumatic motor. As mentioned above, such shop air may carry water vapor even though it has been subject to desiccation or the like.

In the Frederick et al. '588 patent, a blower system is used to carry the media from a media bin to the throw wheel assembly.

Consequently, further advancements in the art remain to be made with respect to the flow of blast shot media throughout the distribution system present and a cryogenic deflashing machine. Such media must flow through the machine as the media must controllably collide with the parts to be deflashed, then leave that area in order to leave the blasted and deflashed parts free from extraneous material such as the blast shot media.

SUMMARY OF THE INVENTION

The present invention provides a media assist system for gaseous nitrogen or the like so that blast shot media may be well distributed and free flowing within the confines of the blast shot media circulatory system in a cryogenic deflashing machine. In order to obtain such a system, gaseous nitrogen may be controllably obtained from a source of liquid nitrogen, such as a local dewar. Liquid nitrogen is used to control temperature in the cryogenic deflashing chamber as well as to provide nitrogen gas for the media assist system of the present invention. A vaporizer converts the liquid nitrogen to nitrogen gas. The vaporizer may be a heat exchanger relying upon ambient temperature to convert the liquid nitrogen, or an electric, thermostatically controlled heater for liquid nitrogen. The gaseous nitrogen may then be piped or otherwise conducted through a flowmeter indicating the rate of nitrogen gas flow.

The flowing nitrogen is transmitted to an air valve assembly having two valves: a media assist valve and a door blast valve. The media assist valve transmits the gaseous nitrogen on to a media assist distribution block assembly which controls the right rear and front cryogenic chamber nozzles used to maintain the workpieces in a dry purge environment as well as to keep the chamber clear of flash and media. The door blast valve transmits nitrogen gas to a Y or T line bifurcator with one line going from the Y to the door blast inlet or nozzle. The other line goes to a Y or T integrator that combines a third line from the media assist distribution block assembly into a single line for transmission of nitrogen gas to the media hopper.

Nitrogen gas enters into the media hopper at its base to force media into the media flow line. The media flow line passes through a media view tube to show that media is actually flowing through the system. As the gaseous nitrogen is generally cold, condensation often occurs even to the point of frost, obscuring the media view tube. A defroster removes frost to ensure that visual contact and inspection of the media view tube can be continuously maintained by an operator.

The nitrogen gas and media are then transmitted to the throw wheel impeller which then accelerates the media shot into the cryogenic deflash chamber and against the workpieces to be deflashed. After colliding with the workpieces and removing flash, the media and separated flash then fall through the holes of the foramenous bucket or chamber into a drain. The drain leads into a media/flash separator that separates the media from the flash. The media is then passed back into the media hopper to again be picked up by gaseous nitrogen for reuse in the cryogenic deflash chamber.

Alternative embodiments are present including the use of venturis to further speed the media shot on its way to the throw wheel impeller.

OBJECTS OF THE INVENTION

It is an object of the present invention to provide a media assist transmission and flow system using gaseous nitrogen or other gaseous fluid to drive media shot through a cryogenic deflashing machine.

It is an additional object of the present invention to provide such a media assist that delivers pressurized gas to a number of cryogenic chamber nozzles as well as driving the media.

It is an additional object of the present invention to provide a controllable valve system so that nitrogen or other gas may be properly distributed throughout a cryogenic deflashing machine.

These and other objects and advantages of the present invention will be apparent from a review of the following specification and accompanying drawings.

BRIEF DESCRIPTION OF THE DRAWINGS

FIG. 1 is a schematic diagram showing in block fashion the structure of the present invention.

DESCRIPTION OF THE PREFERRED EMBODIMENT(S)

Figure 2:
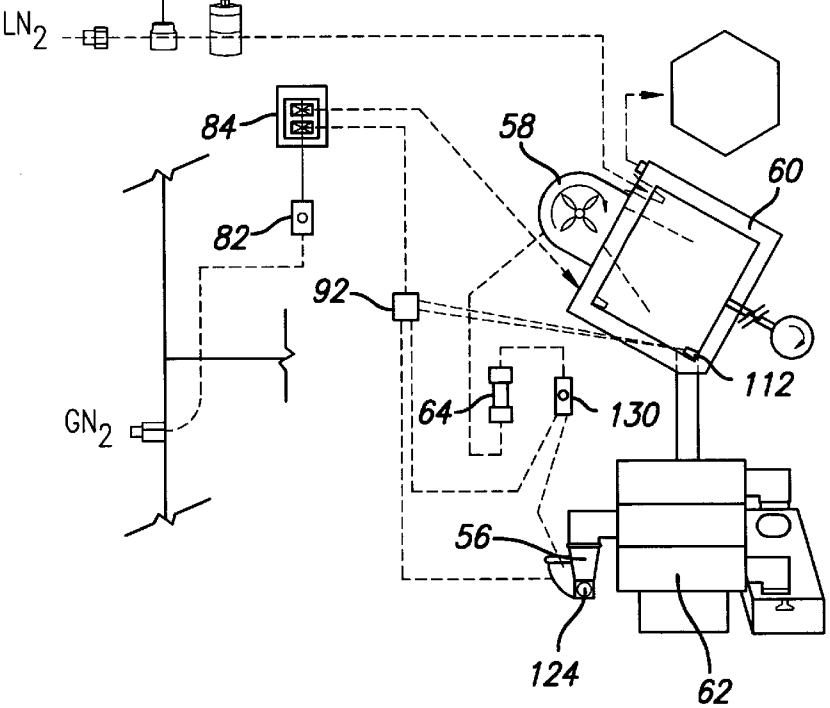
FIG. 2 is a schematic diagram showing an alternative embodiment of the present invention using a venturi to enhance media flow.

The detailed description set forth below in connection with the appended drawings is intended as a description of a presently preferred embodiment of the invention, and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequence may be accomplished by different embodiments that are also intended to be encompassed within the spirit and scope of the invention.

As shown in FIG. 1, the present invention 50 provides a media assist distribution means including the preparation and control of gaseous nitrogen in conjunction with a media flow system for use in a cryogenic deflash chamber. The present invention aids in preventing formation of ice which can impede or block the flow of media through the media flow system. Additionally, a dry purge environment is maintained throughout the confines of the cryogenic deflashing machine, aiding better operation. As drying a moist cryogenic deflashing machine can take several days, the maintenance of a dry environment provides less downtime and more throughput.

The present invention 50 includes a nitrogen gas distribution system 52 as well as and in conjunction with a media flow system 54. The media is generally pelletized polycarbonate shot that is transmitted by tubing or the like from a media hopper 56 to a throw wheel impeller 58 where the shot is forcefully injected into a cryogenic deflash chamber 60 to create controlled impact collisions with workpieces such as parts or components that still manifest flash, burrs, or the like. As the workpieces are held in a foramenous, or perforated, bucket-like container, the media and broken flash fall through the foramenous sides of the container and into the bottom of the cryogenic deflashing chamber 60. A drain in the bottom of the cryo/deflash chamber 60 leads the mixed media and flash into a media/flash separator 62.

The media is then separated from the flash. The media is returned to the media hopper 56 where it can be used again in the deflashing process. In order for an operator to ensure that media is actually flowing through the media distribution system 54, a media view tube 64 is made part of the media distribution system 54. Flowing media is visible through the media view tube 64 and indicates that there is no blockage, such as by ice or the like, preventing the flow of media to the throw wheel impeller 58 and into the cryo/deflash chamber 60.

As the media distribution system 54 uses gaseous nitrogen, there is a tendency for the entire system to become cold to the point of being several, if not over 100°, below ambient temperature. As the gaseous nitrogen used in the present invention is derived from liquid nitrogen (which has a temperature of approximately −341° F., −200° C.), some residual cold may remain in the gaseous nitrogen sufficient to form condensation or frost on the media view tube 64. In order to combat the obscuring effect of frost, making the media view tube 64 opaque, a defroster 66 can be used to cause a continuous flow of warm or ambient gas over the media view tube 64 in order to keep it warm. The defroster 66 keeps the media view tube 64 clear so it can be viewed and so the passage of media through the media view tube 64 can be monitored.

As shown in FIG. 1, the cryo/deflash chamber 60 may be supplied with liquid nitrogen from a dewar or tank 70. The liquid nitrogen dewar can form the ultimate supply of dry nitrogen gas for the entire system of the present invention 50.

Having set forth above the media distribution 54 as an aspect of the present invention, the nitrogen gas distribution 52 also forms a substantial component and operates in tandem with the media distribution system 54.

As shown in FIG. 1, a vaporizer 80 is supplied with a liquid nitrogen ($LN_2$) from the liquid nitrogen dewar or tank 70. The vaporizer 80 may be an electric vaporizer with a thermostatic control, or other vaporizer type including a heat exchanger using ambient temperature to convert the liquid nitrogen to nitrogen gas. Upon vaporization, the resulting nitrogen gas is transmitted to a gaseous nitrogen ($GN_2$) flow meter 82. The nitrogen gas flow meter 82 indicates the flow of nitrogen gas to an operator (if the process is visually monitored) or a sensor (if the flow is monitored electronically or otherwise).

Upon exiting the nitrogen gas flow meter 82, the nitrogen gas enters into an air valve assembly 84 which acts as a controlled and checked valve system to distribute the nitrogen gas for different functions in the cryogenic deflashing machine. The air valve assembly 84 has two electronic valves: a media assist valve 86 and a door blast valve 88. The media assist valve 86 transmits the nitrogen gas to a check valve 90 and on to the media assist distribution block assembly 92. The door blast valve 88 transmits its nitrogen to a check valve 94 and on to a Y or T line bifurcator 96. The door blast Y bifurcator 96 splits the nitrogen transmission flow into two parts, one flowing on to the door blast inlet or nozzle 98 and the other on to the media hopper 56 as set forth in more detail below.

The media assist distribution block assembly 92 splits nitrogen flowing into it into three outflows: a right rear cryo chamber nozzle 110, a right front cryo chamber nozzle 112, and a media hopper flow 114. Like the door blast nozzle 98, the cryo chamber nozzles 110, 112 feed pressurized nitrogen into the cryo/deflash chamber 60. While the door blast nozzle 98 functions at the end of the deflashing cycle in order to clear the adjacent door of any shot, flash, or the like, the cryo chamber nozzles 110, 112 maintain the cryo/deflash chamber 60 in a dry purge environment as well as directing flash and shot falling from the workpiece container into the drain and on to the media/flash separator 62.

The nitrogen gas outflow 114 from the media assist distribution block assembly 92 is fed into a second Y or T line integrator 120. The Y integrator 120 takes nitrogen gas flow from one channel of the door blast Y bifurcator 96 and the nitrogen gas outflow 114 from the media assist distribution block assembly 92 to provide a single outflow of gaseous nitrogen 122 into the base 124 of the media hopper 56. The gaseous nitrogen 122 then participates in the distribution of the media as set forth in the description of the media distribution system 54, above.

Consequently, by the foregoing coordination of the nitrogen gas distribution system 52 and the media distribution 54 of the present invention 50, an effective and water-free environment is provided inside the confines of a cryogenic deflashing machine with useful operating features and characteristics (achieved in a programmable manner) as set forth in more detail below.

In FIG. 2, an alternative embodiment of the present invention is shown where the media assist distribution block assembly 92 provides air not only to the cryo chamber nozzles 110, 112 and the base 124 of the media hopper 56, but also transmits nitrogen gas to a media assist venturi 130 that aids in the propulsion of media through the media distribution system 54. The media assist venturi 130 provides greater pressure for the media, allowing it to flow more forcefully through the media distribution system 54.

Figure 3:
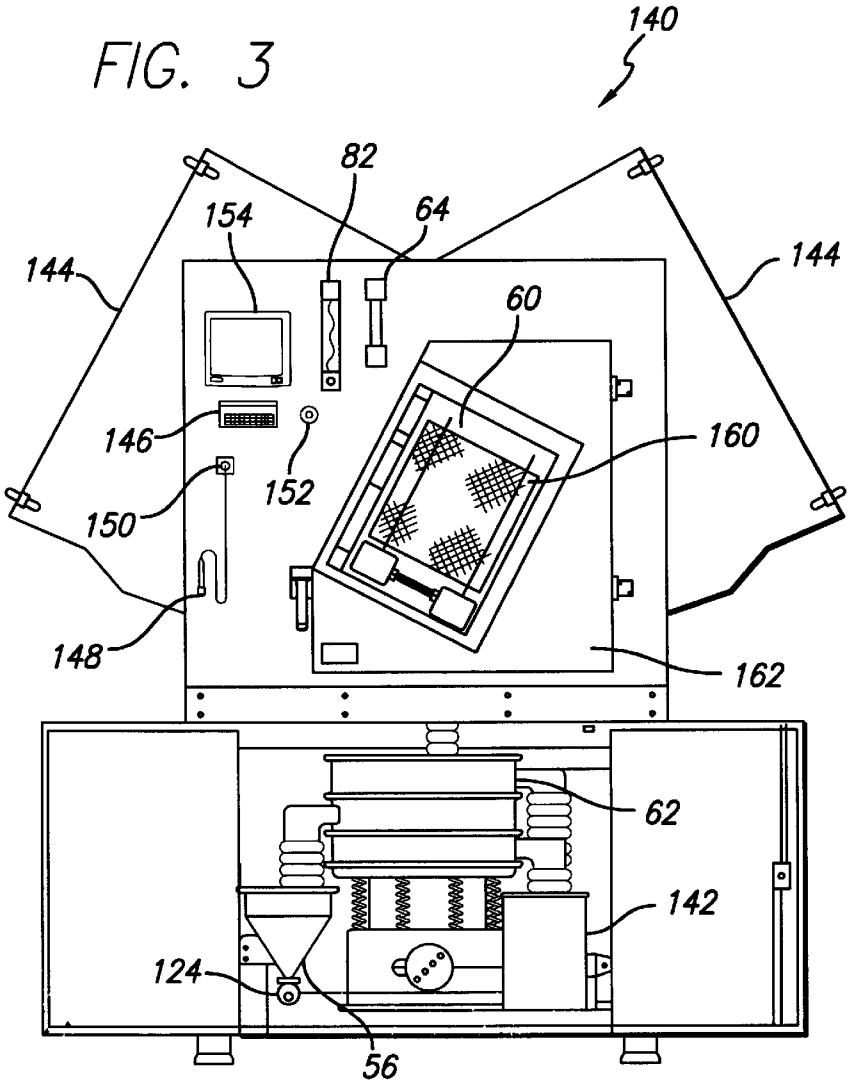
FIG. 3 is a front plan view of a cryogenic deflashing machine incorporating the present invention.

FIG. 3 shows a more detailed view of a cryogenic deflashing machine incorporating the present invention. As can be seen by inspection of FIG. 3, the cryogenic deflashing machine 140 has a cryogenic deflashing chamber 60 in an upper portion while the media hopper 56 is in a lower portion thereof. The media separator 62 leads from the cryogenic deflashing chamber 60 and into the media hopper 56 and the flash hopper 142. Removable gull-wing side panels 144 are shown on either side of the top portion of the cryogenic deflashing machine 140. Additionally, certain elements derived from the computerized control of the cryogenic deflashing machine 140 are shown. These include: a small keypad or keyboard 146, an optical bar code reader 148, a coupling 150 of the bar code reader 148 to the cryogenic deflashing machine 140, an emergency stop button 152, and a display screen or the like 154.

The optical bar code reader or scanner 148 allows work piece routing codes to be scanned into the computer (not shown) accompanying the cryogenic deflashing machine 140. This provides automated programming of the cryogenic deflashing machine 140 so that the operating parameters (such as time, temperature, and media impact force) are automatically preset and implemented by the cryogenic deflashing machine 140. Alternatively, the keypad 146 may be used to program or instruct the computer with respect to the preferred operating characteristics for the workpieces. The keypad 146 can also be used to record and associate certain operating parameters or procedures with specific bar codes.

Workpieces are loaded into the basket 160 which is removable from the cryogenic deflash chamber 60. Upon closing of the door 162, the programmed deflashing sequence is executed by computer control. The present invention provides a dry-purge environment using gaseous nitrogen, so the door 162 has a minimal tendency to freeze to the body of the cryogenic deflashing machine 140. Additionally, media flow is facilitated as freeze-up of the media distribution system 54 is minimized. Upon completion of the deflashing cycle or program, the door blast nozzle 98 is activated with a blast of dry nitrogen gas to clear the lower door frame area of any debris such as flash or media.

Individual components comprising the present invention are shown in FIGS. 4–18. The description below provides greater indication of the construction and architecture of the media assist gaseous nitrogen distribution system for deflashing machines 50 of the present invention.

Figure 4:
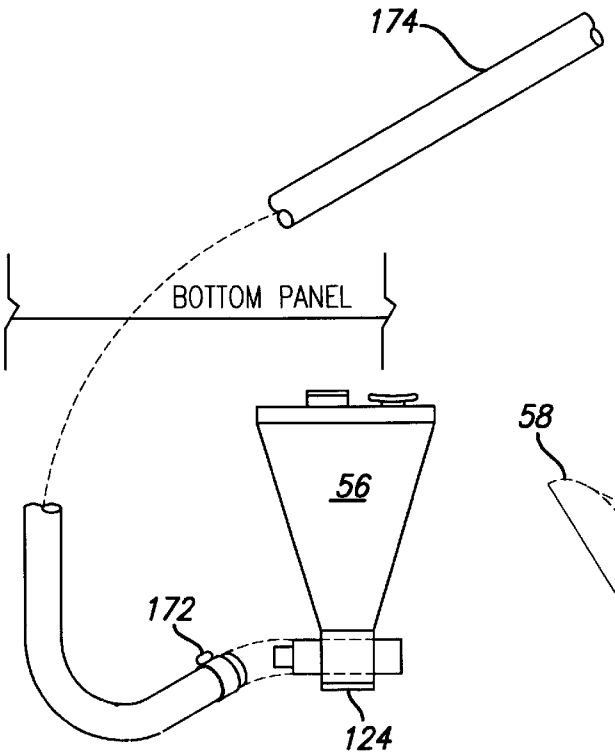
FIG. 4 is a partial schematic view of the present invention showing the media hopper. The media view tube is shown in phantom.

FIG. 4 shows the media hopper 56 with its base 124. An outflow tube leads to the media view tube 64. No. 12 hose clamps 170 secure the tubing to the individual pieces. Smaller, No. 6, hose clamps 172 also connect the lines of the media distribution system 54 to ensure secure connections. As shown, ½" polyurethane tubing 174 may provide a predominant portion of the connecting line. Additionally tubing 176 may provide the connection between the media view tube 64 and the throw wheel impeller 58.

Figure 5:
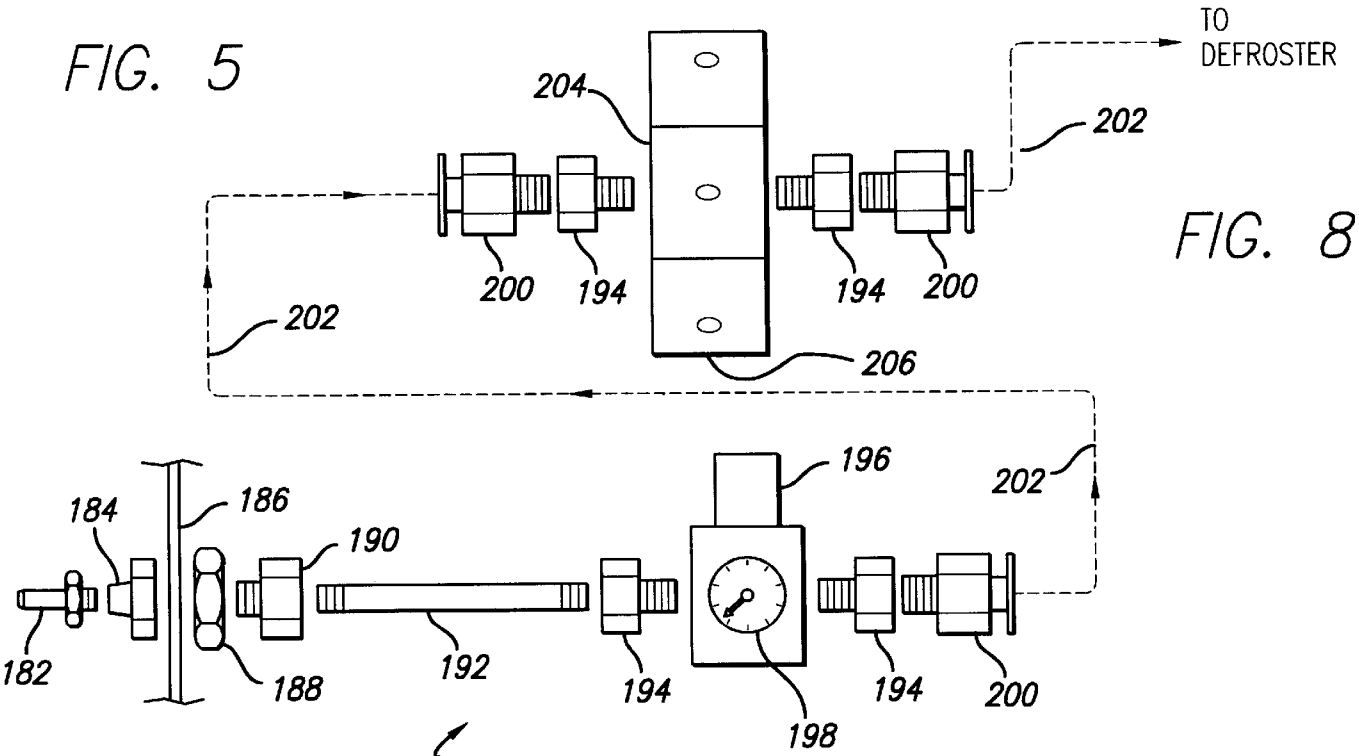
FIG. 5 is a side plan schematic view of the gas flow delivery system to the media view tube defroster.

FIG. 5 shows the gas conduit used in the present invention 50 to provide either air, dry shop air, or gaseous nitrogen to the defroster 66. The defroster gas line 180 has an air nozzle 182 fitted into a reducer coupling 184 to bridge the panel 186. On the interior of the panel 186, an air inlet washer 188 is connected to a reducer bushing 190 which in turn is connected to a pipe nipple 192. The remaining connections may be established through the use of known parts and in reference to FIG. 5, include the following: reducer bushings 194, a gas regulator 196 with a gas pressure gauge 198, male connectors 200, ¼" poly flo tubing 202, an air valve 204 on a mounting plate 206, along with various washers and screws to attach the mounting plate to a stable support within the confines of the cryogenic deflashing machine 140 or the like.

Figure 6:
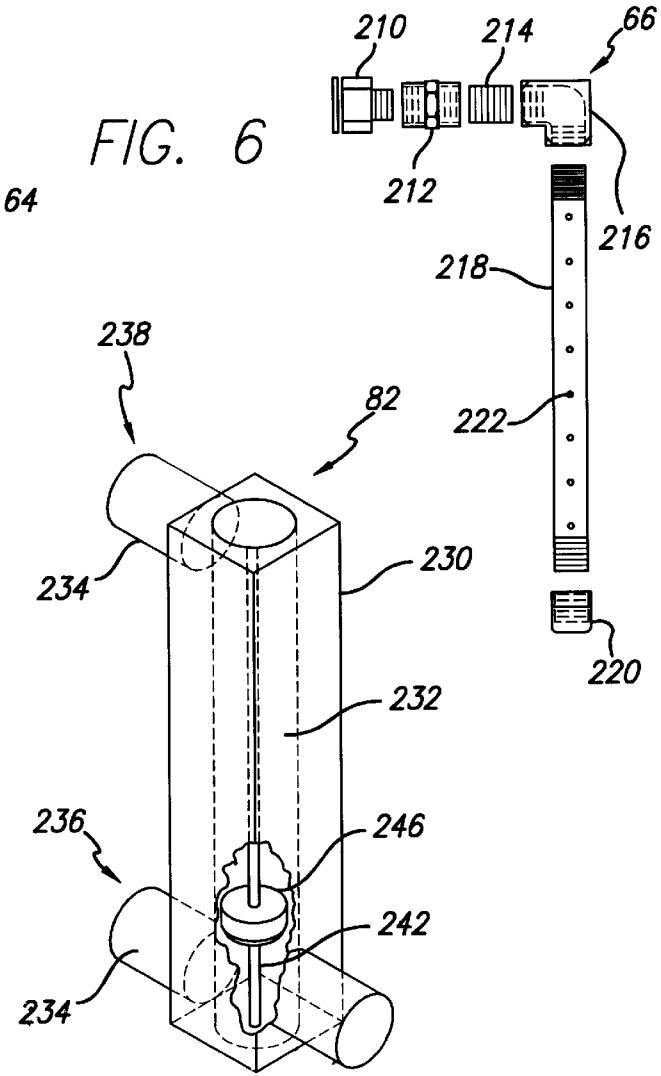
FIG. 6 is a side plan schematic view of the defroster.
Figure 7:
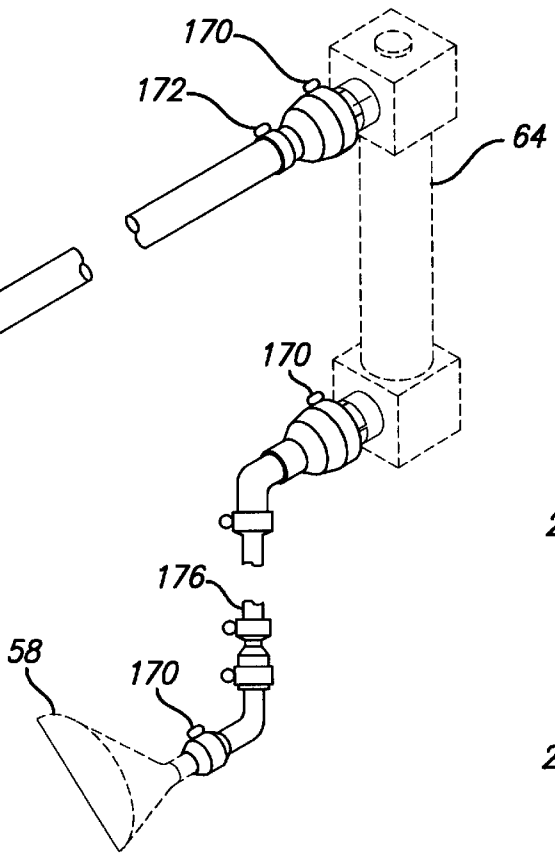
FIG. 7 is a left perspective and partial cut away view of the flow meter of the present invention.

FIG. 6 and FIG. 7 show similar but distinct devices with FIG. 6 showing the defroster 66 and FIG. 7 showing the flowmeter 82. The defroster 66 as shown in FIG. 6 uses a connector 210 as well as a coupling pipe 212, pipe nipple 214 and female elbow 216 to support the main defroster pipe nipple 218. The end of the pipe nipple 218 is held closed by a pipe cap 220.

The main defroster pipe nipple 218 has a series of equally spaced holes 222 that allow pressurized gas from the interior of the main defroster pipe nipple 218 to flow outward and against the media view tube 64. The defroster holes 222 may be conical in shape spreading outward as travel is made from the interior of the main defroster pipe nipple 218 to the exterior. This allows for greater distribution and radiation of gas flowing from the defroster 66 so that it better engages and defrosts the media view tube 64.

FIG. 7 shows the nitrogen gas flow meter 82 which gives a general indication of the flow of nitrogen gas through the nitrogen gas distribution system 52. The flow meter 82 has an outer case 230 that surrounds a hollow interior 232. An exchange PVC outlet fitting with brass fitting 234 may be present at both the inlet 236 and the outlet 238 in order to provide a gas tight fit for the flow meter 82. A float 240 on a spindle or sleeve 242 tends to generally rest towards the bottom portion of the flow meter 82 due to the force of gravity. The weight of the float 240 is chosen so that it indicates the flow of gas from the inlet 236 to the outlet 238 according to chosen pressures. When gas flows from the inlet 236 to the outlet 238, it exerts a force against the float 240, causing it to rise upwardly in the confines of the hollow interior 232 of the flow meter 82. The greater the gas flow, the higher the pressure will be and, consequently, the higher the float 240 will rise within the flow meter 82.

As sometimes there is a question as to whether or not gases flow into the cryogenic deflashing machine and the nitrogen gas distribution system 52 of the present invention 50, and as nitrogen and other gases useful in conjunction with the present invention 50 are generally transparent, the float 240 provides physical means by which gas flow within the gas distribution system 52 may be inspected. This is particularly important as circumstances can arise where the gas flow meter 82 indicates the flow of gas through the gas distribution system 52; however, the media view tube 64 does not show any media flowing therethrough. Under such circumstances, either the gas pressure is too low or the media is being blocked from travel through the media distribution system 54. Experience with the media assist gaseous distribution system of the present invention will indicate to the operator which of the conditions are present, the blockage of media flow often arising from frozen water obstructing the travel of media through the media distribution system 54.

Figure 8:
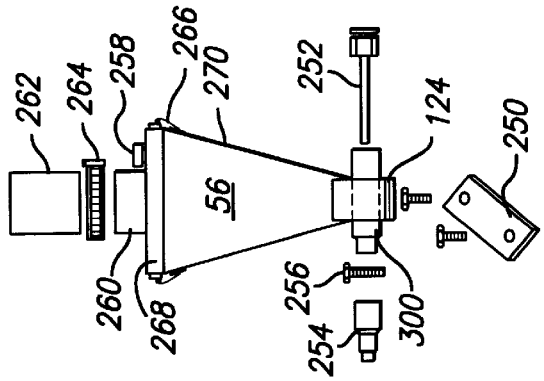
FIG. 8 is a side plan and partially exploded view of the media hopper and base of the present invention.

FIG. 8 shows the media hopper 56 of the present invention. In FIG. 8, a base plate 250 serves to securely attach the bottom portion 124 of the media hopper 56 to the cryogenic deflashing machine. A media assist nozzle 252 is plugged into the bottom 124 of the media hopper 56. On the opposite side, a media assist outlet fitting 254 is secured to the media hopper base 124 by a No. 12 hose clamp or the like 256. An oil filter cap or the like 258 may serve as means by which media may be introduced or extracted from the media hopper 56. An upper opening 260 is connected to the media/flash separator 62 by means of a connector 262 held in place by a No. 52 hose clamp 264. Disengagement of the latches 266 may allow removal of the cover 268 to allow extraction or introduction of media from the main body portion 270 of the media hopper 56.

Figure 9:
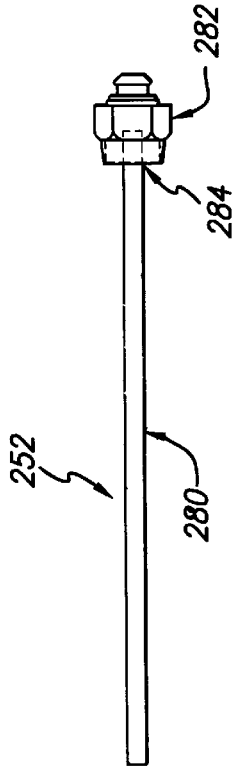
FIG. 9 is a side plan view of the media assist nozzle of the present invention.

FIG. 9 shows the media assist nozzle 252. The media assist nozzle 252 has a long tube 280 welded or otherwise attached to a male connector 282. Epoxy or the like 284 may also be used at the interface between the connector 282 and the tube 280.

Figure 10:
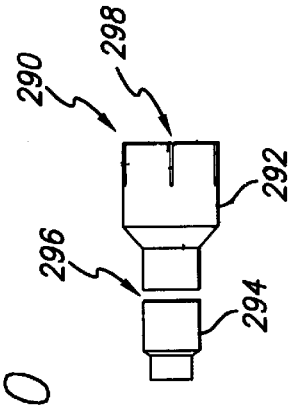
FIG. 10 is a side plan view of the fitting for the view tube inlet and media assist block outlet.

In FIG. 10, a side view of the fitting for the view tube inlet and media assist block outlet 290 is shown. The fitting 290 has a large copper reducer 292 upon which a smaller reducer 294 is held by means of cement or other bonding material 296. The larger reducer 292 may be approximately 1" in diameter to bring to approximately ½". Slots 298 may be present in the larger reducer 292. The slots 298 may be approximately ½" long and 0.03" wide and may be spaced equally about the parameter of the larger reducer 292. The smaller reducer 294 may be approximately ½" tapering down to approximately ⅜".

Figure 11:
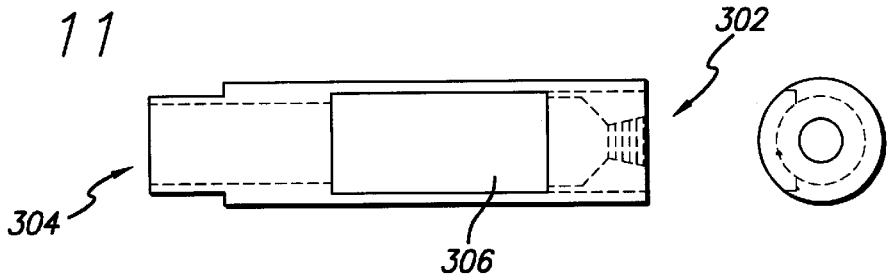
FIG. 11 is a side plan and front plan view of the media lift boss used in conjunction with the media hopper in the present invention.

FIG. 11 shows the media lift boss 300 about which the media hopper base 124 fits and into which the media assist nozzle 252 is threaded. The media lift boss 300 may be made of 6061-T6 aluminum with a diameter of approximately 1.25" at its entrance 302 and stepped down at its tapered outlet to approximately 0.905" inner diameter 304. An upper slot 306 allows media to drop down into the media lift boss 300. The upper slot or opening 306 may be approximately 1" wide and 2.150" long. With this cross-section of opening, the slot 306 freely allows media to drop into the media lift boss 300 as the upper slot/opening 306 is in direct communication with the interior of the media hopper 56.

Figure 12:
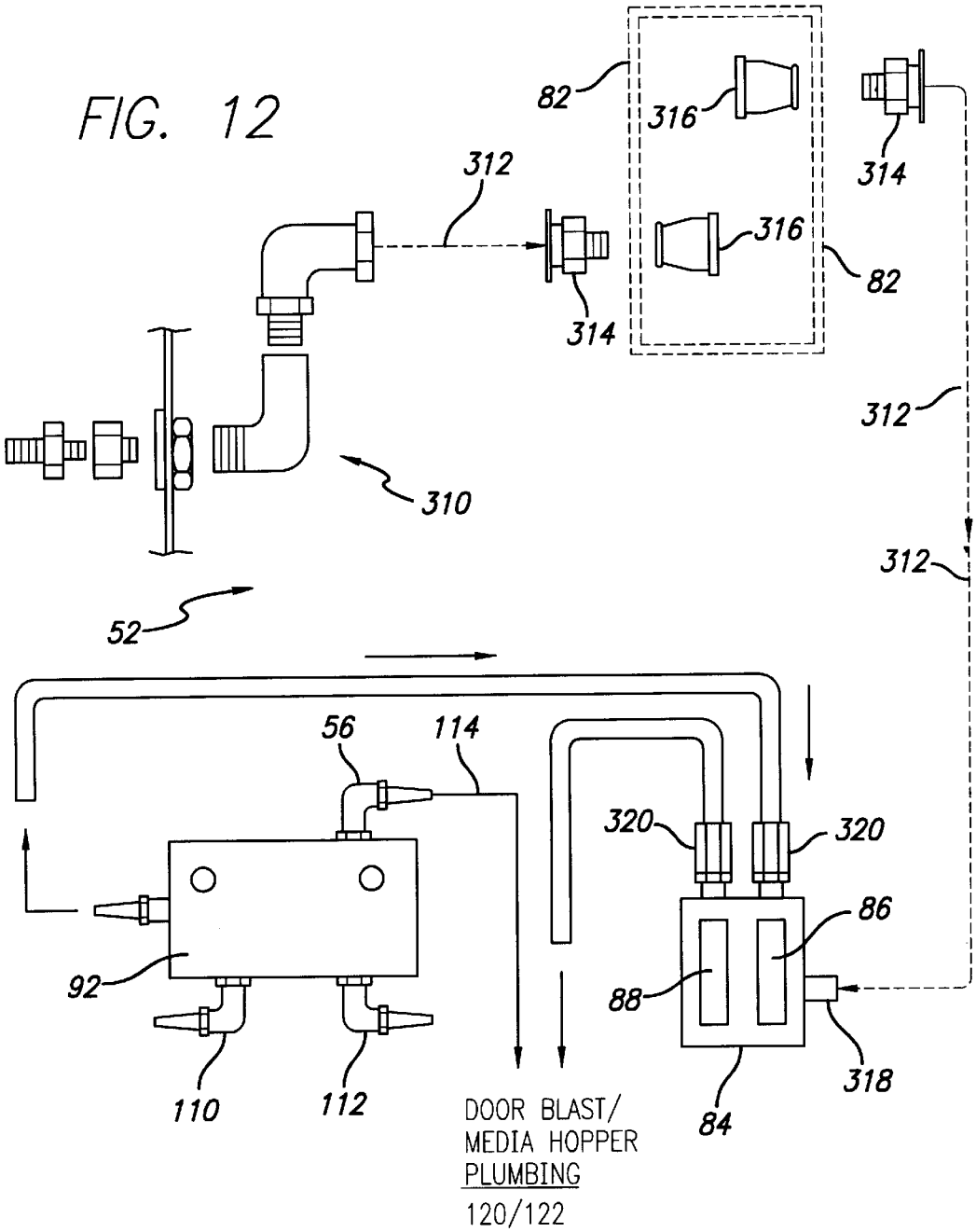
FIG. 12 is a schematic view of gas flow in the present invention.

FIG. 12 shows the gas distribution system 52 of the present invention 50. In FIG. 12, a nitrogen gas inlet assembly 310 (FIG. 14) intermediates flow through an exterior panel in a cryogenic deflashing machine so that nitrogen gas external to the cryogenic deflashing machine may flow into the nitrogen gas distribution system 52 of the present invention 50. A ½" poly flow tube 312 conducts the gas over to the flow meter 82 via a female connector 314 and a reducer coupling 316. Flow from the flow meter 82 proceeds through a second reducer coupling 316 and female connector 314 and through ½" poly flow tubing 312. Nitrogen gas then flows into the air valve assembly 84 via a P-1 port 318. Flow out from the air valve assembly 84 is made via check valves 320 with flow from the door blast valve 88 flowing on to the door blast inlet 98 and flow from the media assist valve 86 flowing on to the media assist distribution block assembly 92. Nitrogen flow then flows on to the right rear and right front cryo chamber nozzles 110, 112 and on to the Y integrator 120 and the inflow to the media hopper base 124 via line 122.

Figure 13:
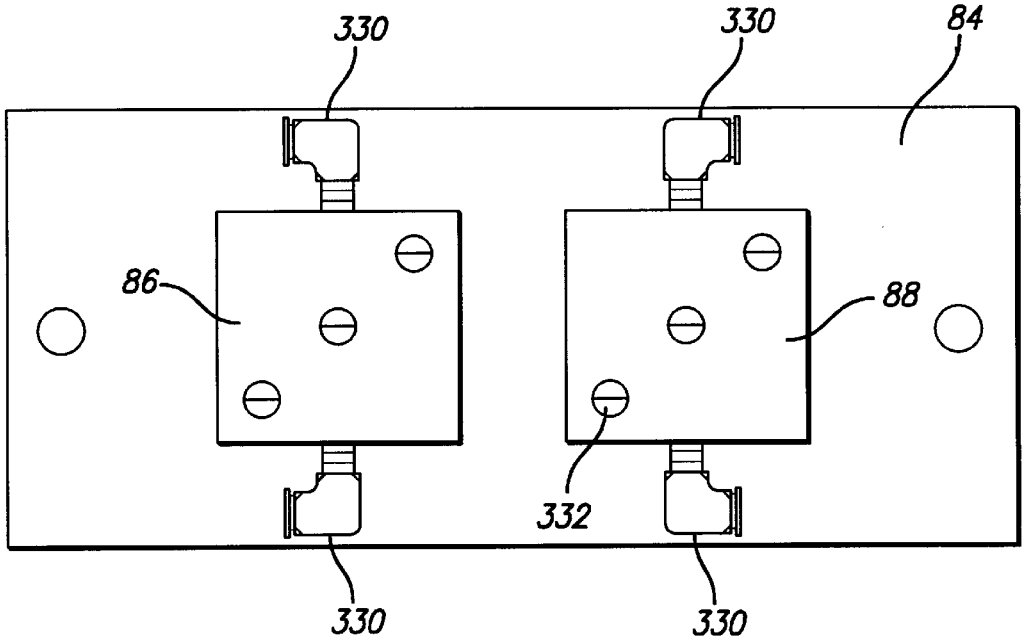
FIG. 13 is a plan view of the air valve assembly used in the present invention.

FIG. 13 shows the air valve assembly 84 with the door blast valve 88 and the media assist valve 86. Male elbows 330 provide inlets and outlets for the valves 86, 88. Additional screws and washers 332 secure the valves 86, 88 to a base plate of the air valve assembly 84.

Figure 14:
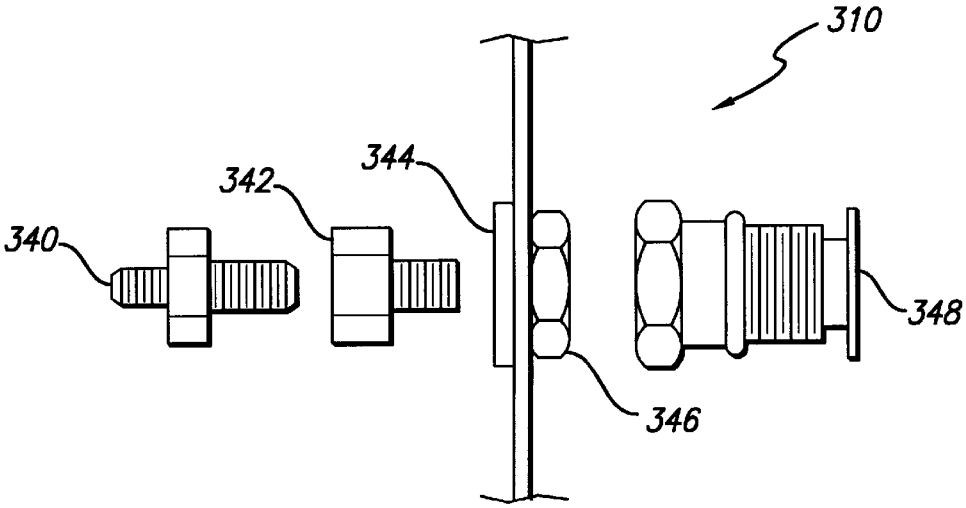
FIG. 14 is a side plan view of a nitrogen gas inlet assembly used in the present invention.

FIG. 14 shows in more detail the nitrogen gas inlet assembly 310 shown in FIG. 12. The nitrogen gas inlet assembly 310 has a male connector 340 attached to a reducer bushing 342, and a flat washer 344. On the interior of the panel, a locknut 346 may secure the male connector 340 to the panel. The locknut and rigid conduit 346 may then support a bulkhead connector 348 attached to the locknut and rigid conduit 346.

Figure 15:
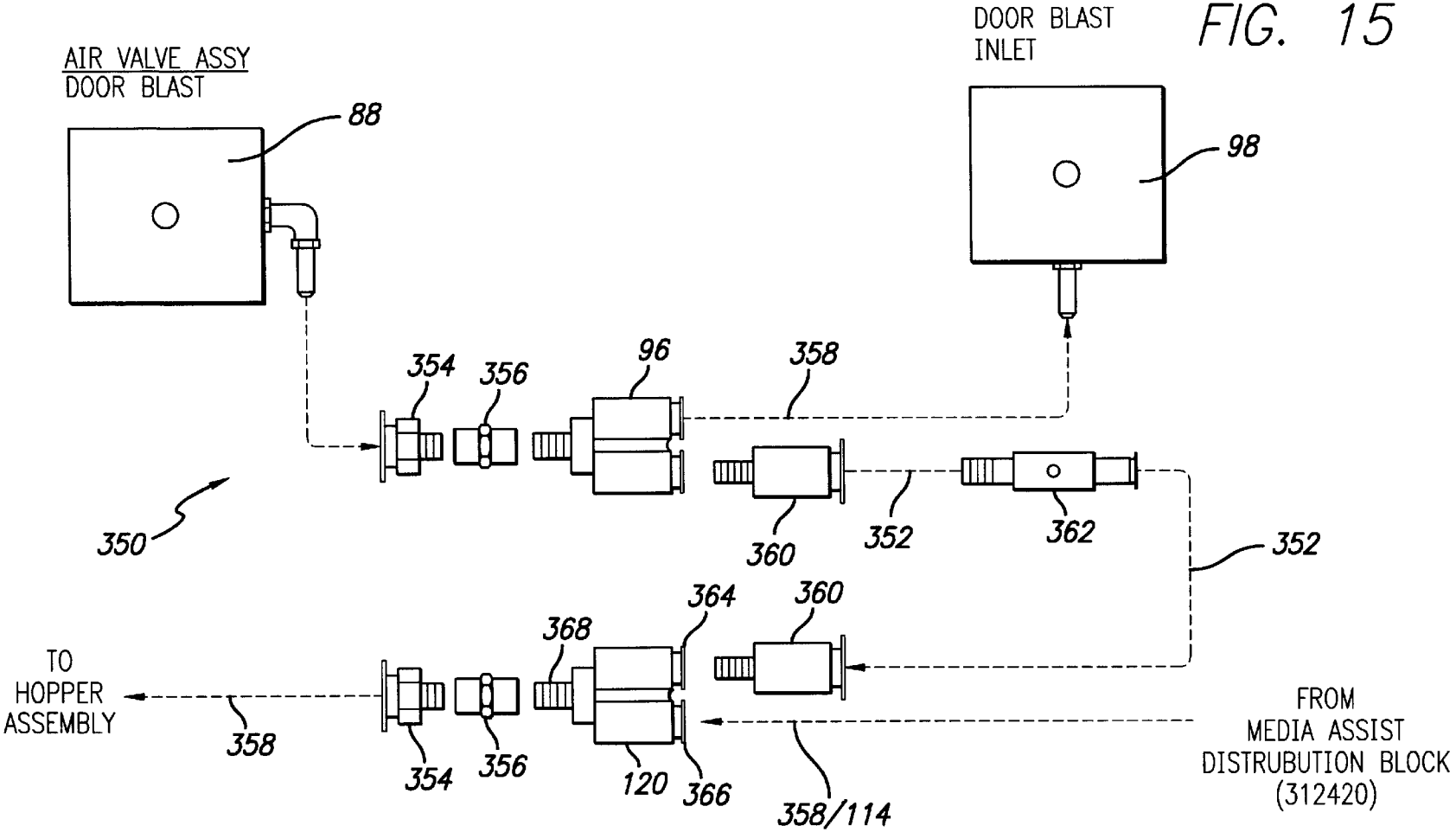
FIG. 15 is a side plan schematic view of gas flow from the air valve assembly to the door blast inlet and the hopper assembly.

FIG. 15 shows the door blast/media hopper plumbing 350 (and is generally indicated as 120/122 in FIG. 12). The door blast valve 88 of the air valve assembly 84 transmits its flow of gas to the door blast inlet 98 and the media lift boss 300 (hopper assembly). To effect the connection between the door blast valve 88 and the gassed outlets (98, 300), the following components are used as fittings intermediating ¼" poly-flow tubing 352: male connectors 354 lead into or lead from pipe couplings 356. One pipe coupling 356 leads into the Y distributor 96. The door blast inlet 98 is coupled to the Y distributor 96 by ⅜" poly flow tubing 358. A plug in reducer 360 couples the other outlet of the Y distributor 96 via tubing 352 to a flow control valve 362. The flow control valve 362 is connected via tubing 352 to another plug in reducer 360. The second plug in reducer 360 fits into one inlet 364 of the Y integrator 120. The other inlet 366 takes its gas flow from the media assist distribution block 92 via media hopper nitrogen outflow 114. The outlet 368 is connected to a coupling pipe 356 which in turn is connected to a male connector 354. ⅜" poly flow tubing 358 then connects the male connector 354 to the hopper assembly/media lift boss 300.

Figure 16:
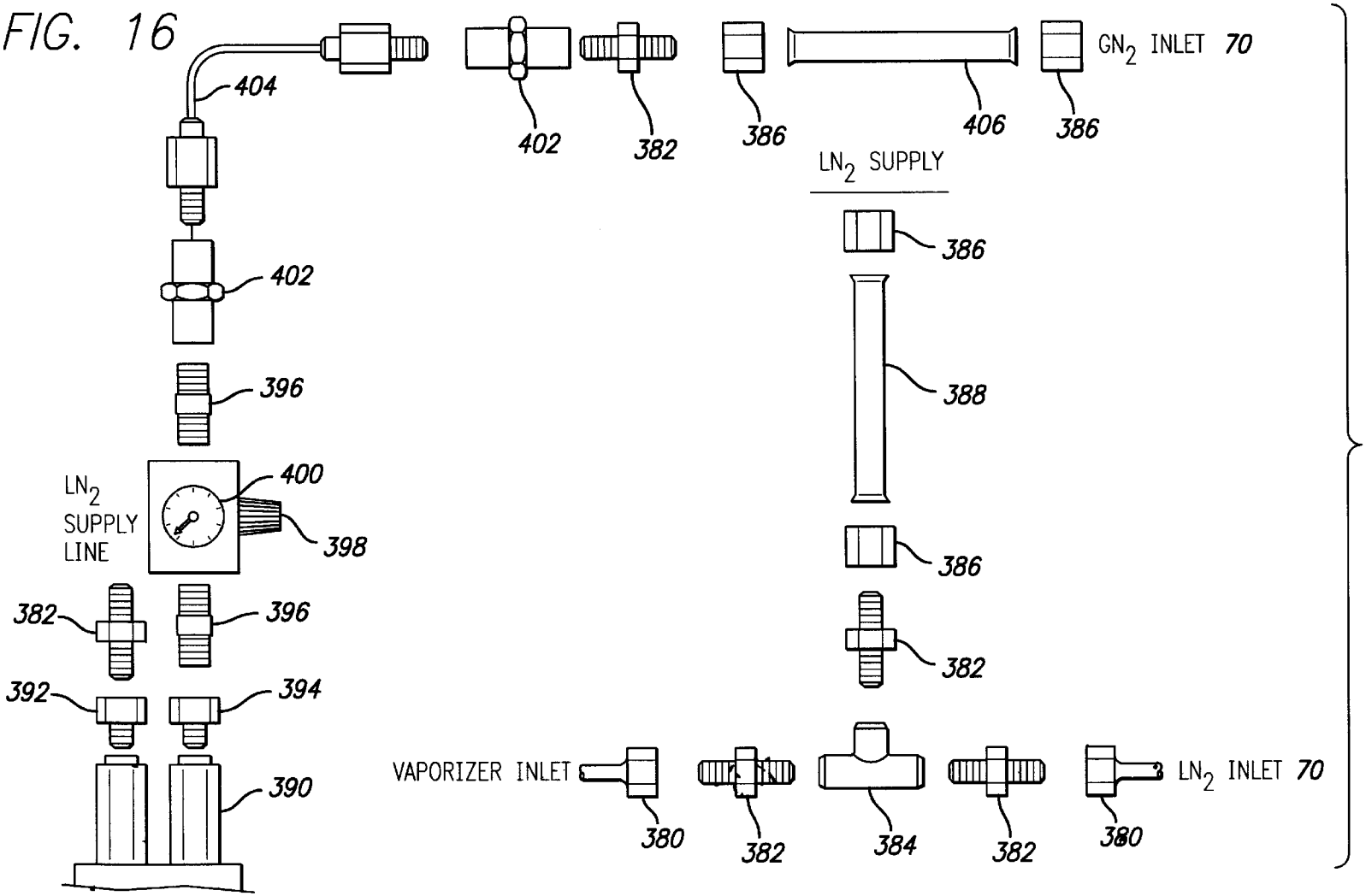
FIG. 16 is a side plan schematic view of the vaporizer assembly with associated upstream and downstream flow lines.

FIG. 16 shows one embodiment of a vaporizer assembly used to provide gaseous nitrogen to the present invention 50 as well as liquid nitrogen. From the liquid nitrogen dewar or tank 70, the flow leads into a flex hose 380. Male connectors 382 are present on all three sides of a female tee 384 that serves to split the flow of liquid nitrogen into a supply to the vaporizer as well as a supply to the cryogenic deflash chamber 60 and any other liquid nitrogen uses for the cryogenic deflashing machine using the present invention 50. On the liquid nitrogen side of the T 384, the male connector 382 connects to a nut and sleeve 386, followed by weld tubing 388 and back into a nut and sleeve 386. Connections present at the cryogenic deflashing machine then connect to the nut and sleeve 386, providing liquid nitrogen supply via the liquid nitrogen plumbing internal to the cryogenic deflashing machine.

The vaporizer side of the female tee 384 uses the flex hose 380 to supply liquid nitrogen from the dewar 70 to the vaporizer 390. The flex hose 380 connects to a male connector 382. The male connector 382 connects to the vaporizer 390 via a reducer bushing 392.

Inside the vaporizer 390, the liquid nitrogen is converted into gaseous nitrogen at a certain controlled temperature. A heat exchanger may use ambient temperature to provide the energy necessary to vaporize the liquid nitrogen. Alternatively, a thermostatically controlled electric heater may also provide heating for the liquid nitrogen in order to gassify it. The supply plumbing shown in FIG. 16 must, can, and does confine the liquid and gaseous nitrogen for both forward and back pressures.

Upon leaving the vaporizer 390, the nitrogen has turned into a gas and flows through a reducer bushing 394 and into a pipe nipple 396 before going into a gas regulator 398 with a pressure gauge 400. The gas regulator 398 controls the forward pressure of the nitrogen gas. Upon leaving the gas regulator 398, the nitrogen flows through a pipe nipple 396, a pipe coupling 402, and on to a nitrogen gas hose 404. The nitrogen gas hose 404 connects to a pipe coupling 402, male connector 382, nut and sleeve 386, and tubing 406. The end of the tubing 406 is also connected to a nut and sleeve 386 which then connects to the nitrogen gas inlet for the cryogenic deflashing machine implementing the present invention 50.

Figure 17:
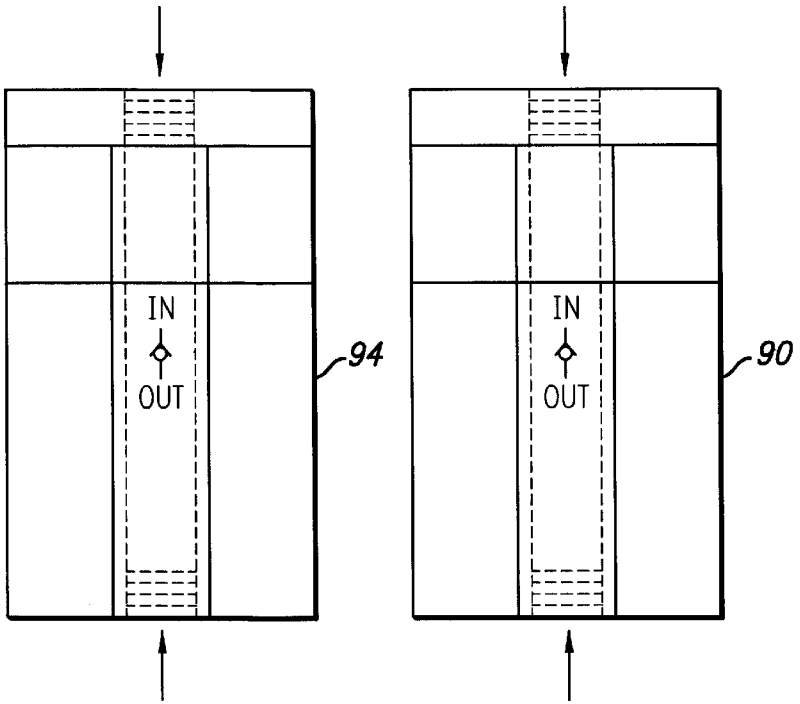
FIG. 17 is a plan view of the check valves used in the air valve assembly.

FIG. 17 shows door blast check valve 94 and a media assist distribution block assembly check valve 90. Both of these check valves are part of the air valve assembly 84.

Figure 18:
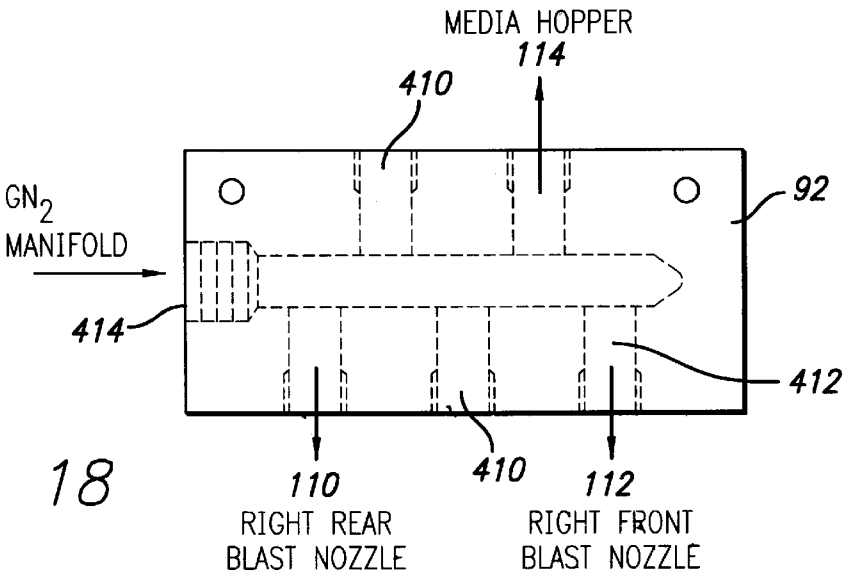
FIG. 18 is a plan view of the media assist distribution block assembly with its internal flow channels shown in phantom.

FIG. 18 shows the media assist distribution block assembly 92 used to distribute nitrogen from the media assist valve 86 of the air valve assembly 84. The media assist distribution block assembly 92 shows five exit ports 412, two of which are plugged with countersunk pipe plugs 410. A male connector (not shown) may connect the media assist distribution block assembly 92 to the air valve assembly 84 via appropriate tubing. The male coupling may connect to the inlet 414 of the media assist distribution block assembly 92. The media assist distribution block assembly 92 may be attached to a mounting plate or the like allowing it to be connected to a stable support within the confines of the cryogenic deflashing machine.

While the present invention has been described with regards to particular embodiments, it is recognized that additional variations of the present invention may be devised without departing from the inventive concept.

What is claimed is:

1. A media assist gas distribution system for use in a cryogenic deflashing machine, comprising:

a source of pressurized gas;

a valve system directing gas flow from said source of pressurized gas to a cryogenic deflash chamber, said valve system distributing said gas into said cryogenic deflash chamber; and a media hopper, said media hopper collecting blast media used in said cryogenic deflash chamber, said media hopper coupled to said valve system and said cryogenic deflash chamber; whereby blast media collecting in said media hopper is transported to said cryogenic deflash chamber by gas flowing from said valve system.

2. The media assist gas distribution system of claim 1, wherein said source of pressurized gas further comprises:

a source of dry nitrogen gas.

3. The media assist gas distribution system of claim 2, wherein said source of dry nitrogen gas further comprises:

a source of vaporized liquid nitrogen.

4. The media assist gas distribution system of claim 3, wherein said source of vaporized liquid nitrogen further comprises:

a liquid nitrogen vaporizer; and a reservoir of liquid nitrogen, said reservoir of liquid nitrogen coupled to said liquid nitrogen vaporizer.

5. The media assist gas distribution system of claim 4, wherein said liquid nitrogen vaporizer further comprises:

a heat exchanger, said heat exchanger extracting heat ambient to said heat exchanger to heat and vaporize liquid nitrogen.

6. The media assist gas distribution system of claim 4, wherein said liquid nitrogen vaporizer further comprises:

a liquid nitrogen heater, said heater heating and vaporizing said liquid nitrogen.

7. The media assist gas distribution system of claim 6, wherein said liquid nitrogen heater further comprises:

a thermostat, said thermostat controlling said heater whereby nitrogen vaporized by said heater is delivered at a constant temperature.

8. The media assist gas distribution system of claim 1, wherein said valve system further comprises:

an air valve assembly, said air valve assembly directing gas flow to a media assist distribution block assembly and a door blast inlet.

9. The media assist gas distribution system of claim 8, wherein said air valve assembly further comprises:

a media assist valve, said media assist valve directing gas flow to said media assist distribution block assembly; and a door blast valve, said door blast valve directing gas flow to said door blast inlet.

10. The media assist gas distribution system of claim 9, wherein said media assist distribution block assembly further comprises:

a first channel directing gas flow to a first cryogenic deflash chamber nozzle;

a second channel directing gas flow to a second cryogenic deflash chamber nozzle; and a third channel directing gas flow to said media hopper.

11. The media assist gas distribution system of claim 10, further comprising:

bifurcation of gas flow from said door blast valve to said door blast inlet, said bifurcation directing gas flow to said media hopper; and integration of said bifurcated gas flow from said door blast valve to said media hopper with gas from said third channel of said media assist distribution block assembly; whereby said media hopper is supplied with media assist gas flow from said door blast valve and said media assist distribution block assembly.

12. A media assist gas distribution system for use in a cryogenic deflashing machine, comprising:

a media distribution system, said media distribution system recycling deflashing blast media from a media hopper to a cryogenic deflash chamber; and a gas distribution system, said gas distribution system distributing gas throughout said cryogenic deflash chamber and propelling said deflashing blast media from said media hopper to said cryogenic deflash chamber.

13. The media assist gas distribution system of claim 12, wherein said media distribution system further comprises:

said media hopper funnelling blast shot media into a media transport line;

a media view tube, said media view tube coupled in line with said media transport line and indicating flow of media through said media distribution system;

a throw wheel impeller, said throw wheel impeller coupled to said media transport line, said throw wheel impeller rapidly propelling said blast shot media;

said cryogenic deflash chamber receiving blast shot media propelled by said throw wheel impeller;

a media/flash separator, said media/flash separator receiving said blast shot media from said cryogenic deflash chamber, said media/flash separator separating said blast shot media from broken or liberated flash from workpieces, said media/flash separator passing separated blast shot media to said media hopper; whereby said blast shot media may be continuously recycled via said media distribution system, reducing an amount of blast shot media needed to feed said cryogenic deflash chamber while providing adequate blast shot for deflashing purposes.

14. The media assist gas distribution system of claim 13, wherein said media distribution system further comprises:

a media view tube defroster adjacent said media view tube, said media view tube defroster transmitting gas upon said media view tube to keep said media view tube free from fog and frost.

15. The media assist gas distribution system of claim 12, wherein said gas distribution system further comprises:

a gas source;

a flow meter coupled to said gas source;

an air valve assembly coupled to said gas source and bifurcating gas flow from said gas source;

a door blast inlet coupled to said air valve assembly, said door blast inlet clearing debris adjacent a door sealing said cryogenic deflash chamber; and a media assist distribution block assembly coupled to said air valve assembly, said media assist distribution block assembly distributing gas to said media hopper and said cryogenic deflash chamber; whereby gas is controllably distributed through the cryogenic deflashing machine and media is propelled from said media hopper to said cryogenic deflash chamber.

16. The media assist gas distribution system of claim 15, further comprising:

bifurcation of gas flow from said air valve assembly to said door blast inlet, said bifurcation directing gas flow to said media hopper; and integration of said bifurcated gas flow to said media hopper with gas from said media assist distribution block assembly flowing to said media hopper; whereby said media hopper is supplied with media assist gas flow from said air valve assembly and said media assist distribution block assembly.

17. A media assist gas distribution system for use in a cryogenic deflashing machine, comprising:

a media hopper, said media hopper collecting blast media used in a cryogenic deflash chamber, said media hopper coupled to said cryogenic deflash chamber;

a liquid nitrogen vaporizer coupled to a reservoir of liquid nitrogen, said liquid nitrogen vaporizer providing a source of pressurized dry nitrogen gas in the form of vaporized liquid nitrogen;

a valve system directing gas flow from said vaporizer to said media hopper and to said cryogenic deflash chamber, said valve system distributing said gas into said cryogenic deflash chamber and having an air valve assembly, said air valve assembly directing gas flow to a media assist distribution block assembly via a media assist valve and directing gas flow to a door blast inlet via a door blast valve;

said media assist distribution block assembly having a first channel directing gas flow to a first cryogenic deflash chamber nozzle, a second channel directing gas flow to a second cryogenic deflash chamber nozzle, and a third channel directing gas flow to said media hopper;

bifurcation of gas flow from said door blast valve to said door blast inlet, said bifurcation directing gas flow to said media hopper; and integration of said bifurcated gas flow from said door blast valve to said media hopper with gas from said third channel of said media assist distribution block assembly so that said media hopper is supplied with media assist gas flow from said door blast valve and said media assist distribution block assembly; whereby blast media collecting in said media hopper is transported to said cryogenic deflash chamber by gas flowing from said valve system and said cryogenic deflash chamber is maintained in a dry purge environment.

18. The media assist gas distribution system of claim 17, wherein said liquid nitrogen vaporizer further comprises:

a heat exchanger, said heat exchanger extracting heat ambient to said heat exchanger to heat and vaporize liquid nitrogen.

19. The media assist gas distribution system of claim 17, wherein said liquid nitrogen vaporizer further comprises:

an liquid nitrogen heater, said heater heating and vaporizing said liquid nitrogen, said heater having a thermostat controlling said heater whereby nitrogen vaporized by said heater is delivered at a constant temperature.

* * * * *